US006896034B2

(12) United States Patent
Strezov et al.

(10) Patent No.: US 6,896,034 B2
(45) Date of Patent: May 24, 2005

(54) METHOD FOR CONTROLLING A CONTINUOUS STRIP STEEL CASTING PROCESS BASED ON CUSTOMER-SPECIFIED REQUIREMENTS

(75) Inventors: Lazar Strezov, Adamstown Heights (AU); Kannapar Mukunthan, Rankin Park (AU); Walter Bleide, Brownsburg, IN (US); Rama Mahapatra, Indianapolis, IN (US)

(73) Assignee: Nucor Corporation, Charlotte, NC (US)

( * ) Notice: Subject to any disclaimer, the term of this patent is extended or adjusted under 35 U.S.C. 154(b) by 62 days.

(21) Appl. No.: 10/420,378

(22) Filed: Apr. 22, 2003

(65) Prior Publication Data

US 2003/0196776 A1 Oct. 23, 2003

Related U.S. Application Data

(62) Division of application No. 09/968,424, filed on Oct. 1, 2001, now Pat. No. 6,581,672.

(60) Provisional application No. 60/236,389, filed on Sep. 29, 2000, provisional application No. 60/236,390, filed on Sep. 29, 2000, and provisional application No. 60/270,861, filed on Feb. 26, 2001.

(30) Foreign Application Priority Data

| | | |
|---|---|---|
| Sep. 29, 2000 | (AU) | PR0479 |
| Sep. 29, 2000 | (AU) | PR0480 |
| Oct. 2, 2000 | (AU) | PR0460 |

(51) Int. Cl.[7] ..... B22D 11/16

(52) U.S. Cl. ..... 164/452; 164/4.1; 164/476; 164/477; 164/154.4; 164/154.7; 148/320; 148/661; 148/541

(58) Field of Search ..... 164/452, 4.1, 476, 164/477, 154.4, 154.7; 148/320, 661, 541

(56) References Cited

U.S. PATENT DOCUMENTS

| | | | | |
|---|---|---|---|---|
| 5,357,443 | A | 10/1994 | Watanbe | |
| 5,567,250 | A | 10/1996 | Akamatsu et al. | |
| 5,727,127 | A | 3/1998 | Schulze et al. | |
| 6,085,183 | A | 7/2000 | Horn et al. | |
| 6,581,672 | B2 * | 6/2003 | Strezov et al. | 164/452 |

FOREIGN PATENT DOCUMENTS

| | | |
|---|---|---|
| DE | 19832762 | 7/1998 |
| DE | 19832762 A1 | 1/2000 |
| EP | 0 541 825 A | 5/1993 |
| JP | 10235540 | 9/1998 |
| JP | 10235540 A | 9/1998 |
| JP | 11057962 A | 3/1999 |

* cited by examiner

*Primary Examiner*—Kiley Stoner
*Assistant Examiner*—I.-H. Lin
(74) *Attorney, Agent, or Firm*—Barnes & Thornburg

(57) ABSTRACT

A method of controlling a continuous steel strip casting process based on customer-specified requirements includes a general purpose computer in which product specifications of steel product ordered by a customer is entered. The computer is configured to automatically map the product specifications to process parameters/set points for controlling the continuous steel strip casting process in a manner to produce the customer ordered product, and in one embodiment produces a process change report detailing such process parameters/set points for operator use in physically implementing such process parameters/set points in the strip casting process. Alternatively, the computer may provide the process parameters/set points directly to the strip casting process for automatic control thereof in producing the customer ordered steel product. The process of the present invention is capable of substantially reducing the time between a customer request for a steel product and delivery thereof over that of conventional steel manufacturing processes.

17 Claims, 5 Drawing Sheets

METHOD FOR CONTROLLING A CONTINUOUS STRIP STEEL CASTING PROCESS BASED ON CUSTOMER-SPECIFIED REQUIREMENTS

CROSS-REFERENCE TO RELATED APPLICATION

This application is a division of and co-owned U.S. application Ser. No. 09/968,424, the disclosure of which is hereby incorporated herein by reference, now U.S. Pat. No. 6,581,672, filed Oct. 01, 2001, which claims the benefit of U.S. Provisional Application Nos. 60/236,389, filed Sep. 29, 2000, 60/236,390 filed Sep. 29, 2000 and 60/270,861 filed Feb. 26, 2001, and of Australian Provisional Application Nos. PR 0460, filed Oct. 2, 2000, PR 0479 filed Sep. 29, 2000, and PR 0480 filed Sep. 29, 2000, the disclosures of which are incorporated herein by reference.

FIELD OF THE INVENTION

The present invention relates generally to systems and methods for providing steel strip to order, and more specifically to systems and methods for converting customer-specified steel strip requirements to process operating parameters for controlling a continuous strip casting process operable to produce the customer-specified steel strip product.

BACKGROUND OF THE INVENTION

The conventional steel industry process for fulfilling a customer's order for a steel product with particular mechanical, dimensional and finish properties is complicated and time-consuming, and may typically require 10 or more weeks to accomplish. Referring to FIG. 1, for example, a flowchart is shown illustrating a flow of one conventional process 10 for producing a customer-ordered steel strip product, wherein the term "strip" as used herein is to be understood to mean a product of 5 mm thickness or less.

Process 10 begins at step 12 where the steel manufacturer receives the customer order, typically set forth in terms of mechanical (e.g., yield strength), dimensional and finish requirements for the steel strip product as well as a desired quantity. Thereafter at step 14, the steel manufacturer determines from the customer order the particular steel chemistry requirements for achieving the product's specified properties. The chemistry requirements are selected from a large recipe list of steel chemistries that is available (and in many cases dates back to ingot casting/hot rolling technology where chemistry was the prime determinant of mechanical and finish properties). Thereafter at step 16, the steel manufacturer determines casting parameters corresponding to operating parameters and/or set points for a steel casting process that will be used to produce steel slabs from molten steel formed in accordance with the steel chemistry requirements. At step 18, the steel manufacturer determines downstream slab processing requirements, initially focusing on achieving the customer's dimensional requirements such as thickness etc and then working through additional downstream processing steps that may be required to achieve the final product properties. Such downstream slab processing requirements may include, for example, any one or combination of (a) slab reheat parameters corresponding to hot mill furnace operating parameters and/or set points for hot strip mill processing, (b) hot rolling parameters corresponding to mill rolling operating parameters and/or set points for hot strip mill processing, (c) cold rolling parameters corresponding to pickling and cold rolling operating parameters and/or set points for cold mill processing, and (d) heat treatment parameters corresponding to heat treatment operating parameters and/or set points for heat treatment.

From step 18, process 10 advances to step 20 where the steel manufacturer produces a batch of molten steel in accordance with the chemistry requirements for the specified steel product and casts the steel product into slab stock in accordance with the casting parameters established at step 16. Oftentimes, customer's orders (which can be as small as 5 tonnes) are batched together until there are sufficient orders to fill one steelmaking heat—typically 100 to 300 tonnes depending on the specific steel plant capacity. This adds further delay to the time that a particular customer's order can be filled, thereby extending the total time for production well in excess of 10 weeks. In any case, process 10 advances from step 20 to step 22 where the slab stock is reheated and hot rolled at hot strip mill, in accordance with the slab reheat and hot rolling parameters established at step 18, to produce steel coil stock of a predefined thickness. Thereafter at step 24, the coil stock is pickled and cold rolled at a cold mill in accordance with any pickling and cold rolling parameters established at step 18 to reduce the thickness of the coil stock to a customer-specified thickness and also to achieve desired properties. Finally, at step 26 the coil stock is heat treated in accordance with any heat treatment parameters established at step 18 to anneal the coil stock such that it meets the requirements of the customer's order.

Conventional steel strip production of the type just described necessitates the production of many different steel grades (typically, in excess of 50) that are first cast into slabs and then processed through complex hot rolling schedules in hot strip mills that produce product in thicknesses as low as 1.5 mm with yield strengths generally in the range 300 to 450 MPa. If the customer requires thinner material or properties outside this range, subsequent processing involving pickle lines, cold reduction mills and annealing furnaces is required.

A primary drawback associated with the conventional steel strip production process just described is the lengthy time period; typically 10 or more weeks, required to produce the steel product that satisfies the customer order. What is therefore needed is an improved steel strip production process that is more responsive to customer needs by greatly reducing the time required to produce customer-specified steel strip product.

SUMMARY OF THE INVENTION

The foregoing shortcomings of the prior art are addressed by the present invention. In accordance with one aspect of the present invention, a method is provided comprising the steps of receiving an order for a steel product including customer-specified requirements relating to said product, mapping said customer-specified requirements to a number of process parameters for controlling a continuous strip steel casting process to produce said steel product, and displaying said number of process parameters on a process change report to an operator of said continuous strip steel casting process.

In accordance with another aspect of the present invention, a method is provided comprising the steps of receiving an order for a steel product including customer-specified requirements relating to said product, mapping said customer-specified requirements to a number of process parameters for controlling a continuous strip steel casting process to produce said steel product, and controlling said continuous strip steel casting process based on said process parameters to produce said steel product.

In accordance with yet another aspect of the present invention, a method is provided comprising the steps of controlling a continuous strip steel casting process based on a set of predefined process parameters to produce a first steel product, receiving an order for a second steel product including customer-specified requirements relating to said second steel product, mapping said customer-specified requirements to a set of new process parameters for controlling said continuous strip steel casting process to produce said second steel product, and substituting said set of new process parameters for said set of predefined process parameters without interrupting said continuous strip steel casting process such that said continuous strip steel casting process immediately switches from producing said first steel product to producing said second steel product.

In each of the foregoing methods according to the present invention, the customer-specified requirements may include a specified steel grade and finish and/or a specified strip thickness, and the process parameters for controlling the continuous strip casting process to produce the customer-specified steel product may include any one or combination of casting speed of the continuous strip casting process, as-cast steel thickness of the steel strip, percentage of hot reduction of the steel strip, cooling rate of the steel strip and coiling temperature of the steel strip and hot rolling temperature range for hot reduction of the steel strip.

The present invention provides an improved method of providing steel strip to meet customer's orders.

The present invention also provides an improved method of substantially reducing the turnaround time between receipt of a customer order for steel strip product and actual production of the steel strip product.

These and other objects of the present invention will become more apparent from the following description of the preferred embodiment.

DESCRIPTION OF THE PREFERRED EMBODIMENT

Figure 1:
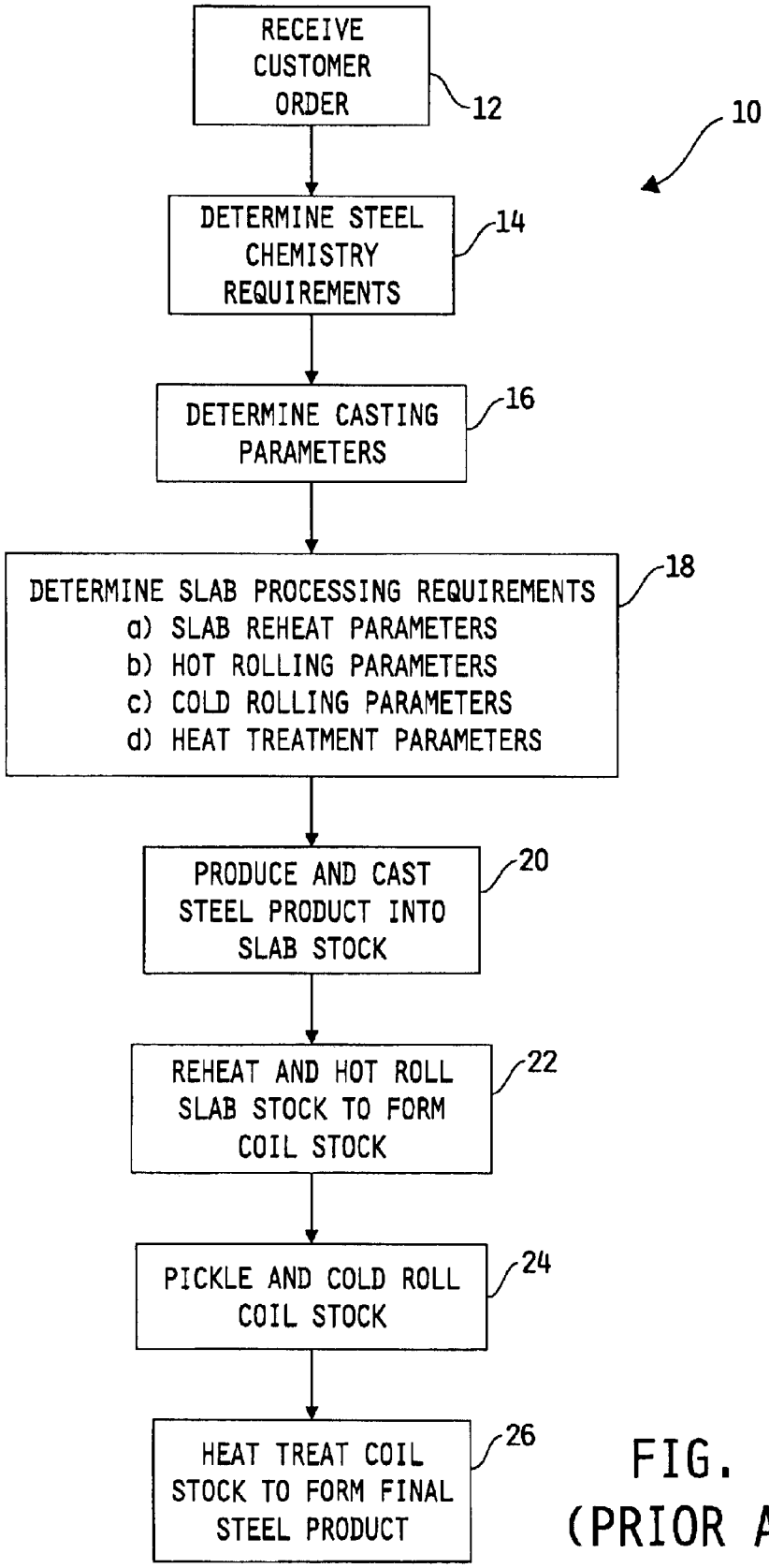
FIG. 1 (PRIOR ART)
FIG. 1 is a flowchart illustrating a conventional steel strip production process.

For the purposes of promoting an understanding of the principles of the invention, reference will now be made to a preferred embodiment illustrated in the drawings and specific language will be used to describe the same. It will nevertheless be understood that no limitation of the scope of the invention is thereby intended, such alterations and further modifications in the illustrated embodiment, and such further applications of the principles of the invention as illustrated therein being contemplated as would normally occur to one skilled in the art to which the invention relates.

The present invention is based on producing steel strip in a continuous strip caster. It is based on extensive research and development work in the field of casting steel strip in a continuous strip caster in the form of a twin roll caster. In general terms, casting steel strip continuously in a twin roll caster involves introducing molten steel between a pair of contra-rotated horizontal casting rolls which are internally water-cooled so that metal shells solidify on the moving rolls surfaces and are brought together at the nip between them to produce a solidified strip delivered downwardly from the nip between the rolls, the term "nip" being used to refer to the general region at which the rolls are closest together. The molten metal may be poured from a ladle into a smaller vessel from which it flows through a metal delivery nozzle located above the nip so as to direct it into the nip between the rolls, so forming a casting pool of molten metal supported on the casting surfaces of the rolls immediately above the nip and extending along the length of the nip. This casting pool is usually confined between side plates or dams held in sliding engagement adjacent the ends of the rolls so as to dam the two ends of the casting pool against outflow, although alternative means such as electromagnetic barriers have also been proposed. The casting of steel strip in twin roll casters of this kind is for example described in U.S. Pat. Nos. 5,184,668, 5,277,243 and 5,934,359, all of which are expressly incorporated herein by reference. Additional details relating to continuous steel strip processing of this type are described in co-pending U.S. patent application Ser. Nos. 09/967,105; 09/967,163; 09/967,166; and 09/966,184; each filed 28 Sep. 2001, and all of which are assigned to the assignee of the present invention and the disclosures of which are each expressly incorporated herein by reference.

It has been determined that it is possible to produce steel strip of a given composition that has a wide range of microstructures, and therefore a wide range of mechanical properties, by continuously casting the strip and thereafter selectively varying downstream strip processing parameters. For example, it has been determined from work carried out on low carbon steel, including plain carbon steel that has been silicon/manganese killed, that selecting cooling rates in the range of 0.01° C./s to greater than 100° C./s to transform the strip from austenite to ferrite can produce steel strip that has yield strengths that range from 200 MPa to greater than 700 MPa. One example of the flexibility of continuous strip casting that has thus been recognized is that a production run of a continuous strip caster that is casting steel strip of a given composition can be controlled such that the cast strip can be selectively subjected to different cooling rates through the austenite to ferrite transition, with the result that the strip can be produced so as to have any selection of a range of different microstructures and therefore mechanical properties (e.g., yield strength).

It has been found, generally, that by selectively varying downstream strip processing parameters in a continuous strip steel casting process, considerable flexibility in terms of operating a continuous strip caster to meet production (i.e. customer-specified) requirements can be realized. This means that orders placed by customers for steel strip of a given dimensional specification and a range of different mechanical properties can be produced from a single steel chemistry in a single production run. In addition, this means that adjustments to a production run can be made in real time while the production run is underway. This has been recognized as being an important advantage of continuous strip casting in terms of meeting customer demands for orders within a short turn around time.

The following description of the preferred embodiment of the present invention is in the context of continuous casting steel strip using a twin roll caster. The present invention is not limited to the use of twin roll casters, however, and extends to other types of continuous strip casters.

Figure 2:
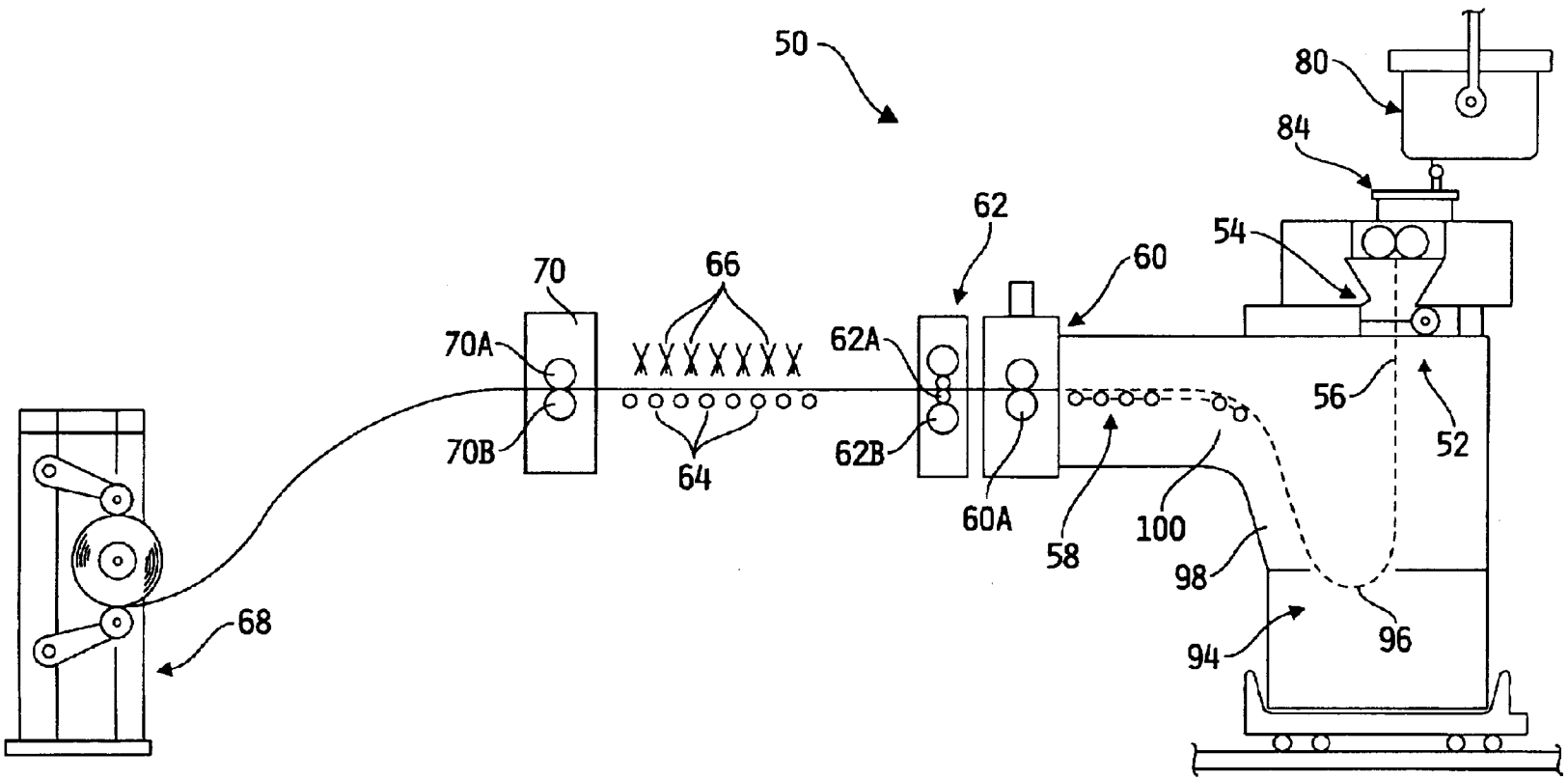
FIG. 2 is a diagrammatic illustration of one preferred embodiment of a continuous steel strip casting apparatus, in accordance with the present invention.
Figure 3:
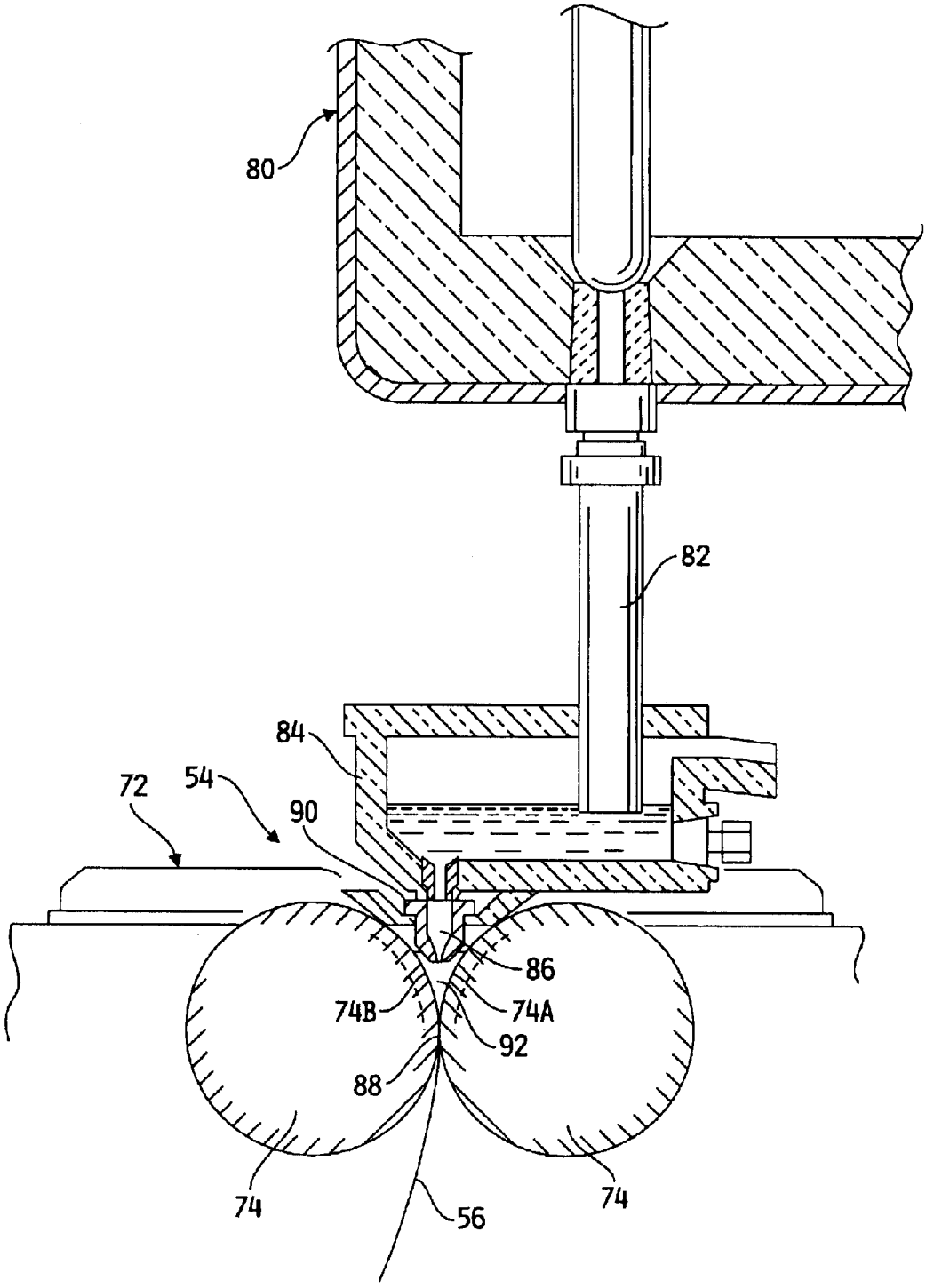
FIG. 3 is a diagrammatic illustration showing some of the details of the twin roll strip caster of the apparatus of FIG. 1.

Referring to FIG. 2, a continuous strip steel casting apparatus/process 50 is illustrated as successive parts of a production line whereby steel strip can be produced in accordance with the present invention. FIGS. 2 and 3 illustrate a twin roll caster denoted generally as 54 which produces a cast steel strip 56 that passes in a transit path 52 across a guide table 58 to a pinch roll stand 60 comprising pinch rolls 60A. Immediately after exiting the pinch roll stand 60, the strip passes into a hot rolling mill 62 comprising a pair of reduction rolls 62A and backing rolls 62B in which it is hot rolled to reduce its thickness. The rolled strip passes onto a run-out table 64 on which it may be force cooled by water jets 66 and through a pinch roll stand 70 comprising a pair of pinch rolls 70A and 70B, and thence to a coiler 68.

Referring now to FIG. 3, twin roll caster 54 comprises a main machine frame 72 which supports a pair of parallel casting rolls 74 having a casting surfaces 74A and 74B. Molten metal is supplied during a casting operation from a ladle (not shown) to a tundish 80, through a refractory shroud 82 to a distributor 84 and thence through a metal delivery nozzle 86 into the nip 88 between the casting rolls 74. Molten metal thus delivered to the nip 88 forms a pool 92 above the nip 88 and this pool 92 is confined adjacent the ends of the rolls by a pair of side closure dams or plates 90 which are applied by a pair of thrusters (not shown) comprising hydraulic cylinder units connected to the side plate holders. The upper surface of pool 92 (generally referred to as the "meniscus" level) may rise above the lower end of the delivery nozzle 86 so that the lower end of the delivery nozzle 86 is immersed within this pool 92.

Casting rolls 74 are water cooled so that shells solidify on the moving roll surfaces and are brought together at the nip 88 between them to produce the solidified strip 56 which is delivered downwardly from the nip 88 between the rolls 74. The twin roll caster 54 may be of the kind which is illustrated and described in some detail in U.S. Pat. Nos. 5,184,668 and 5,277,243 or U.S. Pat. No. 5,488,988, the disclosures of which are each expressly incorporated herein by reference.

Figure 4:
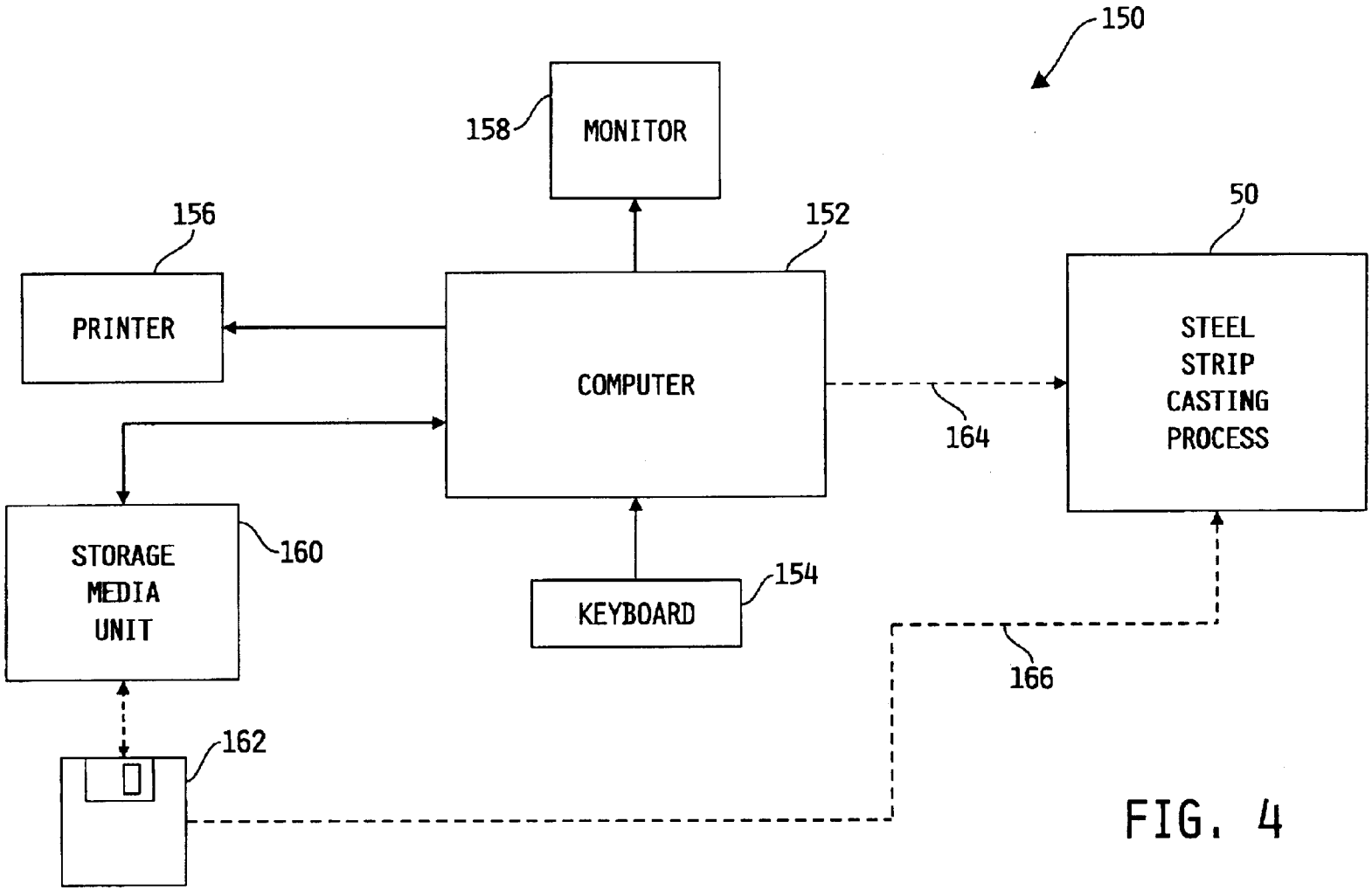
FIG. 4 is a block diagram illustration of a general purpose computer system operable to convert customer-specified steel strip requirements to process parameters for controlling the continuous steel strip casting apparatus of FIGS. 2 and 3.

In accordance with the present invention, customer orders for steel strip are entered into a general purpose computer system, such as computer system 150 of FIG. 4, and processed in a manner to be more fully described hereinafter to determine process parameters and/or process set points for controlling a continuous steel strip casting process such as continuous steel strip casting process 50 just described with respect to FIGS. 2 and 3 to thereby satisfy the customer's order. Referring to FIG. 4, general purpose computer system 150 includes a general purpose computer 152 that may be a conventional desktop personal computer (PC), laptop or notebook computer, or other known general purposed computer configured to operate in a manner to be described subsequently. Computer system 150 includes a conventional keyboard 154 electrically connected to computer 152 for entering information relating to the customer's order therein, and may include any one or combination of output devices. For example, computer 152 may be electrically connected to a printer 156, wherein computer 152 may be configured to print a set of process parameters in the form of a process change report or similar report, wherein the process change report sets forth the process parameters and/or set points for controlling a continuous steel strip casting process, such as continuous steel strip casting process 50 illustrated in FIGS. 2 and 3, in a manner to produce the customer ordered steel strip product. In one embodiment of the present invention, an operator of the continuous steel strip casting process, such as process 50, views the process change report and makes corresponding physical changes to the continuous steel strip casting process to thereby produce the customer ordered steel strip product.

Computer 152 may alternatively or additionally be electrically connected to a conventional monitor 158, wherein computer 152 may be configured to display a set of process parameters in the form of a process change report or similar report, wherein the process change report sets forth the process parameters and/or set points for controlling a continuous steel strip casting process, such as continuous steel strip casting process 50 illustrated in FIGS. 2 and 3, in a manner to produce the customer ordered steel strip product. An operator of the continuous steel strip casting process, such as process 50, may view the process change report displayed on the monitor 158, in addition to or in place of a printed report, and make corresponding physical changes to the continuous steel strip casting process to thereby produce the customer ordered steel strip product.

Computer 152 is also electrically connected to a conventional storage media unit 160, wherein computer 152 is configured to store information to, and retrieve information from, storage unit 160 in a known manner. In one embodiment of the present invention, computer 152 is configured to download a set of process parameters in the form of a process change report or similar report to a storage media 162 via storage unit 160, wherein the process change report sets forth the process parameters and/or set points for controlling a continuous steel strip casting process, such as continuous steel strip casting process 50 illustrated in FIGS. 2 and 3, in a manner to produce the customer ordered steel strip product. An operator of the continuous steel strip casting process, such as process 50, may then access the contents of the storage media via conventional techniques to view the process change report and make corresponding physical changes to the continuous steel strip casting process to thereby produce the customer ordered steel strip product. Storage media unit 160 and storage media 162 may be implemented as any known storage media unit and storage media combination. Examples include, but are not limited to, a magnetic disk read/write unit 160 and magnetic diskette 162, CD ROM read/write unit 160 and CD ROM disk 162, and the like.

In an alternative embodiment, the continuous steel strip casting process, such as continuous steel strip casting process 50 illustrated in FIGS. 2 and 3, is a computer-controlled process, and in this case computer system 150 may be configured to provide the process change report directly (electronically) to process 50 via a suitable communication link 164 as shown in phantom in FIG. 4. Alternatively still, computer 152 may be configured in such an embodiment to download the process change report to storage media 162, wherein an operator loads the storage media 162 containing the process change report into a storage media unit (not shown) similar to storage media unit 160 resident within process 50 as illustrated in FIG. 4 by dashed line 166. In either case, the continuous steel strip casting process, such as process 50, is responsive to the process change report to automatically make corresponding process changes and/or apparatus set point changes. It is to be understood, however, that regardless of how process and/or set point changes are made to the continuous steel strip casting process, the strip casting process apparatus is responsive to such changes to directly switch from producing the steel strip product that it is currently producing to producing steel strip product according to the new process parameter/process set point information.

Figure 5:
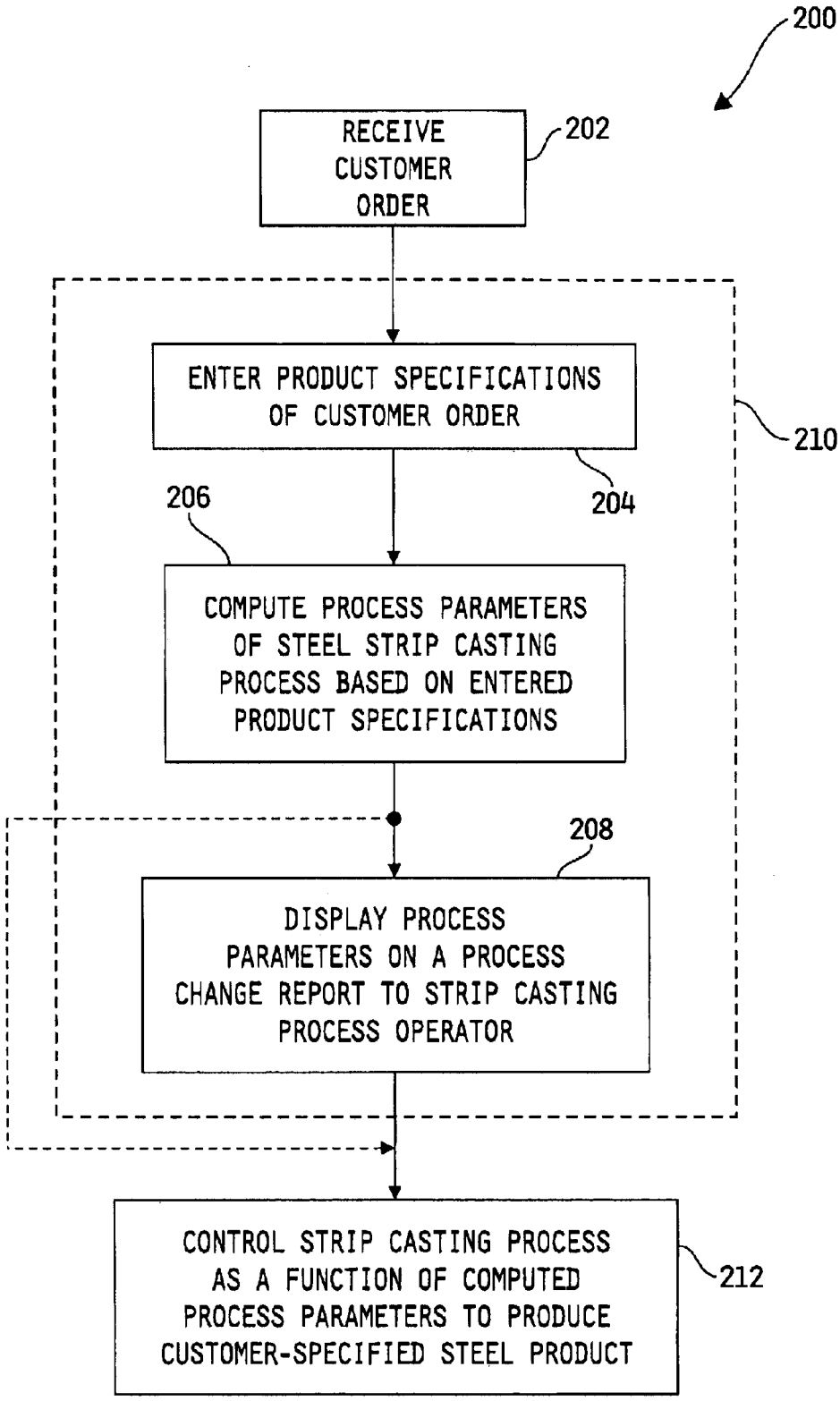
FIG. 5 is a flowchart illustrating one preferred embodiment of a process flow for controlling the continuous steel strip casting apparatus of FIGS. 2 and 3 using the general purpose computer of FIG. 4.

Referring now to FIG. 5, a flowchart is shown illustrating one preferred embodiment of a process 200 for controlling a continuous strip steel casting process, such as process 50 illustrated and described with respect to FIGS. 2 and 3, to produce a customer-specified steel strip product. Process 200 begins with an initial step 202 of receiving a customer order for a steel strip product having specified mechanical properties or product specifications. In one embodiment, the product specifications include a desired grade of the steel product, a desired strip thickness and total strip quantity, although the present invention contemplates requiring additional or alternative information, such as mechanical and finish properties, relating to the customer ordered product. Thereafter at step 204, the product specifications are entered into computer 152 via any known mechanism therefore. For example, an operator may key the information into computer 152 via keyboard 154, or if the information is provided by the customer on a storage media such as a diskette, an operator may simply upload the information into the computer via storage media unit 160. Alternatively, the present invention contemplates entering the product specifications into computer 152 in accordance with other known techniques not detailed in the attached drawings, wherein such other known techniques may include, but are not limited to, transferal of the product specifications via a telephone modem connection between computer 152 and a customer computer, transferal of the product specifications via an internet connection, or the like.

In any case, process 200 advances from step 204 to step 206 where computer 152 is operable to compute the process parameters and/or process set points for controlling a continuous steel strip casting process, such as process 50, in a manner to produce the customer ordered steel product, based on the product specifications entered into computer 152 at step 204. In accordance with the present invention, computer 152 is programmed with one or more sets of rules relating the product specifications entered into computer 152 at step 204 corresponding to a set of process parameters/set points for controlling the continuous steel strip casting process in a manner to produce the customer ordered steel product. The one or more sets of rules may be implemented as any one or combination of one or more tables, one or more graphs, one or more equations, and the like. An example of one illustrative set of rules is set forth below in Tables I and II.

Table I details a set of rules mapping product specifications relating to steel products that may be ordered by any customer to hot band product processing parameters/set points for the continuous steel strip casting process 50 shown and described herein. As they relate to table I, ASTM-specified steel grades for hot band products are associated with the following yield strengths (YS) and percent elongations (% Elong):

| ASTM Grade | YS (ksi) | % Elong |
|---|---|---|
| Grade 33 | 33 to 43 | 30 to 35 |
| Grade 40 | 40 to 50 | 25 to 30 |
| Grade 50 | 50 to 60 | 20 to 25 |
| Grade 65 | 65 to 75 | 15 to 20 |
| Grade 80 | 80 to 90 | 10 to 15 |

The residual level indicators L, M and H in Table I are defined by the relationships Low (L)<0.35%, Med (M)=0.8%, and High (H)=1.2%, and the cooling rate indicators L, M and H in Table I are generally defined by the ranges Low (L)≦60° C./s, 60° C./s<Medium (M)<200° C./s and High (H)≧200° C./s.

TABLE I

| Hot band product specifications CUSTOMER ORDER | | Caster process set points | | | | | |
|---|---|---|---|---|---|---|---|
| | | Level of residuals (Cu + Sn + | Casting | As-cast | | ROT cooling curve | |
| Thickness (mm) | ASTM grade | Mo + Ni + Cr) | Speed (m/min) | thickness (mm) | % hot reduction | Cooling Rate* | Coiling Temp (° C.) |
| 0.04" | Grade 33 | | | | | | |
| (1.0 mm) | | | | | | | |
| 0.04" | Grade 40 | L | 80 | 1.6 | 38 | | 700 |
| (1.0 mm) | | | | | | | |
| 0.04" | Grade 50 | L | 80 | 1.6 | 38 | M | |
| (1.0 mm) | | M | 80 | 1.6 | 38 | | 700 |
| 0.04" | Grade 65 | L | 80 | 1.6 | 38 | H | |
| (1.0 mm) | | M | 80 | 1.6 | 38 | M | |
| | | H | 80 | 1.6 | 38 | | 650 |
| 0.04" | Grade 80 | M | 80 | 1.6 | 38 | H | |
| (1.0 mm) | | L | 80 | 1.6 | 38 | H | |
| 0.047" | Grade 33 | | | | | | |
| (1.2 mm) | | | | | | | |
| 0.047" | Grade 40 | L | 80 | 1.6 | 25.0 | | |
| (1.2 mm) | | | | | | | 700 |
| 0.047" | Grade 50 | L | 80 | 1.6 | 25.0 | M | |
| (1.2 mm) | | M | 80 | 1.6 | 25.0 | | 700 |
| | | L | 45 | 1.9 | 37 | | 650 |

TABLE I-continued

| Hot band product specifications CUSTOMER ORDER | | Caster process set points | | | | | |
|---|---|---|---|---|---|---|---|
| | | Level of residuals (Cu + Sn + | Casting | As-cast | | ROT cooling curve | |
| Thickness (mm) | ASTM grade | Mo + Ni + Cr) | Speed (m/min) | thickness (mm) | % hot reduction | Cooling Rate* | Coiling Temp (° C.) |
| 0.047" | Grade 65 | L | 80 | 1.6 | 25.0 | H | |
| (1.2 mm) | | M | 80 | 1.6 | 25.0 | M | |
| | | H | 80 | 1.6 | 25.0 | | 650 |
| 0.047" | Grade 80 | H | 80 | 1.6 | 25.0 | H | |
| (1.2 mm) | | M | 80 | 1.6 | 25.0 | H | |
| 0.055" | Grade 33 | | | | | | |
| (1.4") | | | | | | | |
| 0.055" | Grade 40 | L | 80 | 1.6 | 12.5 | | 700 |
| (1.4 mm) | | | | | | | |
| 0.055" | Grade 50 | L | 80 | 1.6 | 12.5 | L | |
| (1.4 mm) | | M | 80 | 1.6 | 12.5 | | 650 |
| | | L | 45 | 1.9 | 26.0 | | 650 |
| 0.055" | Grade 65 | L | 80 | 1.6 | 12.5 | M | |
| (1.4 mm) | | | | | | | |
| 0.055" | Grade 80 | L | 80 | 1.6 | 12.5 | M | |
| (1.4 mm) | | H | 80 | 1.6 | 12.5 | | 650 |
| 0.063" | Grade 33 | | | | | | |
| (1.6 mm) | | | | | | | |
| 0.063" | Grade 40 | L | 80 | 1.6 | 0.0 | | 700 |
| (1.6 mm) | | | | | | | |
| 0.063" | Grade 50 | L | 80 | 1.6 | 0.0 | L | |
| (1.6 mm) | | M | 80 | 1.6 | 0.0 | | 650 |
| 0.063" | Grade 65 | L | 80 | 1.6 | 0.0 | M | |
| (1.6 mm) | | | | | | | |
| 0.063" | Grade 80 | L | 80 | 1.6 | 0.0 | M | |
| (1.6 mm) | | H | 80 | 1.6 | 0.0 | | 650 |
| 0.075" | Grade 33 | | | | | | |
| (1.9 mm) | | | | | | | |
| 0.075" | Grade 40 | L | 45 | 1.9 | 0.0 | | 700 |
| (1.9 mm) | | | | | | | |
| 0.075" | Grade 50 | M | 45 | 1.9 | 0.0 | | 650 |
| (1.9 mm) | | | | | | | |
| 0.075" | Grade 65 | H | 45 | 1.9 | 0.0 | | 650 |
| (1.9 mm) | | | | | | | |
| 0.075" | Grade 80 | | | | | | |
| (1.9 mm) | | | | | | | |

*cooling rate in the 850–400 ° C. temperature range

A general set of rules for hot band products used to generate the Table I values are summarized in Table II below, wherein the term "chemistry" refers to the level of residuals in the steel product, and wherein the Low, Med and High levels are as defined above, and wherein the Low (L), Medium (M) and High (H) levels of cooling rate are also as defined above.

TABLE II

| Chemistry | % HR | Cooling rate | Yield strength MPa |
|---|---|---|---|
| Low | <15 | M | 550 |
| Low | 25–40 | H | 550 |
| Med | 25–40 | H | 550 |
| High | 0–50 | L | 550 |
| Low | <15 | M | 475 |
| Low | 25–40 | H | 475 |
| Med | 25–40 | M | 475 |
| High | 0–50 | L | 475 |
| Low | <15 | L | 400 |
| Low | 25–40 | M | 400 |
| Med | 25–40 | L | 400 |
| Low | 0–50 | L | 350 |

From Table I, it should now be apparent that the process parameters required to produce a customer-specified hot band steel product may include any one or combination of casting speed of the continuous strip casting process, as-cast steel thickness of the steel strip, percentage of hot reduction of the steel strip, cooling rate of the steel strip and coiling temperature of the steel strip. It will be appreciated that Table I can be modified to include, as another column of caster set points, temperature ranges for hot reduction of the steel strip corresponding to hot rolling temperature ranges through the austenite to ferrite transition, wherein such temperature ranges will typically be generally within the 850–400° C. range.

Referring again to FIG. 5, process 200 advances from step 206 to step 208 where computer 152 is operable in one embodiment of the present invention to display the process parameters on a process change report to a continuous strip casting operator. It will be appreciated that step 208 is typically included only when computer 152 is not operable to automatically control the continuous steel strip casting process 50 as described hereinabove, and may otherwise be omitted from process 200. If included, computer 152 may be configured to display the process change report via any one or more of the output devices described hereinabove with respect to FIG. 4. In this embodiment, dashed-line box 210 outlines the steps of process 200 that are executed by computer 152. Additionally, as described hereinabove, the present invention contemplates embodiments wherein computer 152 is operable to receive the customer order electronically, and dashed-line box 210 may be extended in such embodiments to include step 202.

Following step 208, process 200 advances to step 212 where the continuous strip casting process, such as continuous strip casting process 50 illustrated and described with respect to FIGS. 2 and 3, is controlled as a function of the process parameters computed at step 206 to thereby produce the customer-specified steel product. In embodiments of process including step 208, step 212 is generally not executed by computer 152 but is instead carried out by an operator of the continuous steel strip casting process. The operator executes step 212 in such embodiments by physically implementing the process parameters/set points set forth in the process change report. In embodiments wherein computer 152 is configured to provide the process parameters/set points directly (electronically) to the continuous steel strip casting process, step 208 may be omitted and step 206 may advance directly to step 212. In such embodiments, computer 152 may be configured to automatically implement the process parameters/set points computed at step 206 in the continuous steel strip casting process, and these cases dashed-line box 210 extends to include step 212.

In accordance with the present invention, computer system 150 is operable to map the customer-specified product specifications to a production run schedule for a steel of a selected composition. Typically, a production run schedule for a given steel chemistry may extend for at least several days during which steel strip is continuously cast by the twin roll caster 54. Depending upon the number of orders and ordered specifications, an entire production run may be concerned with producing steel strip having one particular set of mechanical properties or for producing steel strip of a number of different selected mechanical properties along the length of the strip.

The production run schedule takes into account parameters such as casting speed, hot rolling temperature range, amount of hot reduction, and cooling rates through the austenite to ferrite transition (typically 850 to 400° C.) to produce final microstructures in the cast strip that provide the strip with the required mechanical and finish properties and the consequential materials handling issues associated with changing the cooling rates of the strip.

By adjusting the cooling rate within the range of 0.01° C./s and in excess of 100° C./s it is possible to produce cast product having microstructures including:

(i) predominantly polygonal ferrite;
(ii) a mixture of polygonal ferrite and low temperature transformation products, such as Widmanstatten ferrite, acicular and bainite; and
(iii) predominantly low temperature transformation products.

In the case of low carbon steels, such a range of microstructures can produce yield strengths in the range of 200 MPa to in excess of 700 MPa. After the production run schedule has been established, the twin roll caster 54 can be operated to produce cast strip in accordance with the production schedule and the strip can be delivered to customers as required.

One advantageous feature of the method of the present invention is that it is possible to adjust a production run schedule during the course of a production run to accommodate production on a short turn around basis of a strip order of required mechanical properties. Thus, in the method of the present invention: a single steel chemistry is used to produce a wide range of mechanical properties—thus customer's orders no longer need to be delayed until a heat/batch quantity of orders is assembled; strip casting in conjunction with control of hot rolling temperature, degree of hot reduction and the strip cooling rate can enable the achievement of the customer's dimensional specification and required mechanical properties simultaneously within one production line typically less than 70 meters in length; properties can be changed in real time by modifying appropriate set points on key process control loops in a central control computer and thus the time from receipt of customer order to product dispatch can be as little as 1–2 weeks as opposed to conventional steel production method that takes 10–12 weeks; and the very short order to delivery time enables the concept of a "virtual warehouse" and "just in time" production via the application of e-commerce.

While the invention has been illustrated and described in detail in the foregoing drawings and description, the same is to be considered as illustrative and not restrictive in character, it being understood that only preferred embodiments thereof have been shown and described and that all changes and modifications that come within the spirit of the invention are desired to be protected.

What is claimed is:

1. A method of controlling a continuous strip steel casting process to produce a customer-specified steel product, the method comprising:

receiving an order for a steel product including customer-specified requirements relating to said product;

mapping said customer-specified requirements to a number of process parameters for controlling a continuous strip steel casting process to produce said steel product; and controlling said continuous strip steel casting process based on said process parameters to produce said steel product.

2. The method of claim 1 wherein said customer-specified requirements include thickness of said steel product.

3. The method of claim 2 wherein said customer-specified requirements include grade of said steel product.

4. The method of claim 1 wherein said number of process parameters includes casting speed of said continuous strip steel casting process.

5. The method of claim 4 wherein said number of process parameters includes as-cast thickness of said steel product.

6. The method of claim 5 wherein said number of process parameters includes percentage of hot reduction of said steel product.

7. The method of claim 6 wherein said number of process parameters includes cooling rate of said steel product.

8. The method of claim 7 wherein said number of process parameters includes hot rolling temperature of said steel product.

9. A method of controlling a continuous strip steel casting process to produce a customer-specified steel product, the method comprising:

receiving an order for a steel product including customer-specified requirements relating to said product; and mapping said customer-specified requirements to a number of process parameters for controlling a continuous strip steel casting process to produce said steel product.

10. The method of claim 9 further including controlling said continuous strip steel casting process based on a process parameters displayed on a process change report to produce said steel product.

11. The method of claim 9 wherein said customer-specified requirements include thickness of said steel product.

12. The method of claim 9 wherein said customer-specified requirements include grade of said steel product.

13. The method of claim 9 wherein said number of process parameters includes casting speed of said continuous strip steel casting process.

14. The method of claim 9 wherein said number of process parameters includes as-cast thickness of said steel product.

15. The method of claim 9 wherein said number of process parameters includes percentage of hot reduction of said steel product.

16. The method of claim 9 wherein said number of process parameters includes cooling rate of said steel product.

17. The method of claim 16 wherein said number of process parameters includes the hot rolling temperature of said steel product.

* * * * *